US009157195B2

(12) United States Patent
Vázquez Ruíz Del Árbol

(10) Patent No.: US 9,157,195 B2
(45) Date of Patent: Oct. 13, 2015

(54) METHODS AND DEVICES FOR FORMING CONTRACTION JOINTS IN CONCRETE WORKS

(76) Inventor: José Ramón Vázquez Ruíz Del Árbol, Madrid (ES)

( * ) Notice: Subject to any disclaimer, the term of this patent is extended or adjusted under 35 U.S.C. 154(b) by 0 days.

(21) Appl. No.: 13/264,797

(22) PCT Filed: Apr. 13, 2010

(86) PCT No.: PCT/ES2010/070225

§ 371 (c)(1),
(2), (4) Date: Jan. 9, 2012

(87) PCT Pub. No.: WO2010/119157

PCT Pub. Date: Oct. 21, 2010

(65) Prior Publication Data

US 2012/0121327 A1 May 17, 2012

(30) Foreign Application Priority Data

Apr. 17, 2009 (ES) ..... 200901015

(51) Int. Cl.
*E01C 11/04* (2006.01)
*E01C 23/02* (2006.01)

(52) U.S. Cl.
CPC ..... *E01C 11/04* (2013.01); *E01C 23/026* (2013.01)

(58) Field of Classification Search
USPC ..... 404/47, 48, 50, 74, 87
See application file for complete search history.

(56) References Cited

U.S. PATENT DOCUMENTS

| | | | | | |
|---|---|---|---|---|---|
| 1,505,174 | A | * | 8/1924 | Triol | 404/51 |
| 2,027,725 | A | * | 1/1936 | Fischer | 404/50 |
| 2,078,693 | A | * | 4/1937 | Simrall | 404/50 |
| 2,098,870 | A | | 11/1937 | Heltzel | |
| 2,300,995 | A | * | 11/1942 | Tufts | 404/51 |
| 2,311,286 | A | * | 2/1943 | Tufts | 404/50 |
| 2,321,067 | A | | 6/1943 | De Witt | |
| 2,729,152 | A | * | 1/1956 | Carnes | 404/87 |
| 3,256,786 | A | * | 6/1966 | Middlestadt | 404/50 |
| 3,366,022 | A | * | 1/1968 | Mock | 404/74 |
| 3,473,450 | A | * | 10/1969 | Koch | 404/87 |
| 3,572,226 | A | | 3/1971 | Rasmussen | |

(Continued)

FOREIGN PATENT DOCUMENTS

| | | |
|---|---|---|
| ES | 400205 A1 | 1/1975 |
| FR | 2 320 404 | 3/1977 |

(Continued)

*Primary Examiner* — Abigail A Risic
(74) *Attorney, Agent, or Firm* — Ladas & Parry LLP

(57) ABSTRACT

Procedures and devices for the formation of retraction joints in works of concrete. The devices are made of a material for separating concrete and have a configuration that comprises: a) A vertical wall (15, 15') in its top portion that is planned to be placed underneath the surface fissure line of the retraction joint on the top face of a surface of the concrete; b) Two prismatic surfaces (17, 17') equal on their bottom part deployed on alternate sides with respect of the vertical wall and configured for the formation of entries and exits imbricated between adjacent slabs forming the faces of support (21, 21') of one slab over the other at angles of between 0° and −10° with respect of the horizontal plane. The procedures are based on the insertion of the devices in fresh concrete in the position planned for each retraction joint using a machine.

11 Claims, 2 Drawing Sheets

(56) References Cited

U.S. PATENT DOCUMENTS

| | | | | |
|---|---|---|---|---|
| 4,332,504 | A * | 6/1982 | Arai | 404/68 |
| 2011/0103890 | A1 * | 5/2011 | Simons et al. | 404/87 |

FOREIGN PATENT DOCUMENTS

| | | | |
|---|---|---|---|
| FR | 2320404 | A1 | 3/1977 |
| RU | 2 341 607 | C2 | 12/2008 |

* cited by examiner

METHODS AND DEVICES FOR FORMING CONTRACTION JOINTS IN CONCRETE WORKS

FIELD OF THE INVENTION

The present invention refers to procedures and devices for the formation of retraction joints in works of concrete or works of other materials, such as gravel—cement, in which the phenomenon of retraction is produced and, more specifically, to procedures and devices that enable the slabs or other elements of concrete separated by the joints to be left with their edges supporting each other.

The invention is applicable to linear works such as streets, roads, canals, collectors, motorways, railways, dikes, and on surface works such as port and airport concourses, as well as spacial works such as walls, tanks, floors, roofs, prefabricated buildings and dams.

BACKGROUND OF THE INVENTION

The applicant of the present invention has already proposed the procedures and devices for the formation of retraction joints in works of concrete disclosed in Spanish patent applications ES 2 149 103 and ES 2 224 866.

ES 2 149 103 discloses a procedure of articulated imbrication between slabs of concrete that permits the edges of said slabs to have entrances and exits that imbricate the adjacent slabs over each other. For this, the essential element is the use of some means alternately placed on one side and the other of the plane of the axis of the joint perpendicular to the ground, inclined at the same angle with respect of the ground and alternately varying the direction of the gradient to one side and the other of said plane. When the concrete fissures due to retraction or by the application of loads, these means enable the formation of said entries and exits. The patent discloses several specific means formed on the basis of metal mesh.

ES 2 224 866 discloses devices consisting in a plurality of trays of a concrete separating material mounted on rigid linear elements on one side and the other in an alternating manner, and another linear fissure surface on the top face of the concreted surface which leaves free spaces between them to allow fissuring.

Although said devices enable obtaining the imbrication of the adjacent slabs, to do so it is necessary for them to be duly placed in the planned spot for the formation of the retraction joint, and that the pouring and spreading of the concrete over them does not change their position.

This can become an obstacle in the execution of the works of concrete and the present invention is directed towards its solution.

SUMMARY OF THE INVENTION

The object of the present invention is to provide procedures and devices that facilitate the imbrication of adjacent slabs in works of concrete in the places planned for the retraction joints, and that do not necessarily require the placement of devices on the ground for forming the joints before extending the concrete.

Another object of the present invention is to provide procedures and devices that facilitate the imbrication of adjacent slabs in works of concrete in the places planned for the retraction joints and that can be used during the same process of extending the concrete.

In a first aspect, these and other objectives are obtained with a device for the formation of retraction joints in pavements of concrete made with a separating material of concrete having a configuration comprising:

A vertical wall in its top part that is planned to be placed underneath the surface fissure line of the retraction joint on the top face of the concreted surface;

Two equal prismatic surfaces on their bottom part deployed on alternate sides with respect of said vertical wall and configured for the formation of entries and exits imbricated between adjacent slabs in the shape of teeth, forming support faces of one slab over the other at angles of between 0° and −10° with respect of the horizontal plane.

In a second aspect, these and other objectives are obtained with a procedure for the formation of retraction joints in pavements of concrete that comprises the following steps:

Providing devices for the formation of joints with the indicated features.

Inserting a plurality of said adjacent devices in the place planned for each retraction joint and following the extension of the concrete.

In a third aspect, these and other objectives are obtained with a machine for the formation of retraction joints in pavements of concrete by means of the insertion of said devices that comprises:

A ruler equipped with a pusher plate for each one of said devices.

Means of vertical displacement of said ruler;

A means of vibration of concrete.

In a preferred embodiment, said devices are formed by two substantially equal trays except in the different orientation of the prismatic surface with respect of the vertical wall that is opposite in each case. Thus it is a longitudinal joint comprising several devices, each one of them formed by two trays, said prismatic surfaces being alternately deployed on each side of the vertical wall, and the top edge having a continuous seal joint. The two types of said trays incorporate cooperating means for their lateral union. This facilitates the prefabrication of the devices and the formation in situ of a longitudinal joint uniting said trays.

In the preferred embodiments the dimensions of said devices fall within the following ranges: the vertical walls and prismatic surfaces have some heights H1, H2 falling within 20% to 70% of the height of the pavement; their length L falls between 20 cm and 200 cm; width A of said prismatic surfaces falls between 0.5 cm and 10 cm. In this way appropriate devices are obtained, especially for paving roads.

Other features and advantages of the present invention will be disclosed in the detailed description that follows from an exemplary embodiment, in no way restrictive, of the same in relation to the accompanying Figures.

DETAILED DESCRIPTION OF THE INVENTION

Figure 1:
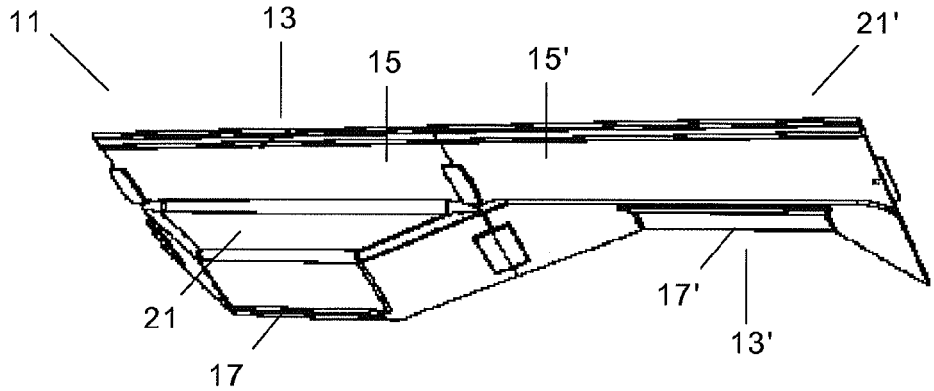
FIGS. 1 and 2 are two perspective views of a device for the formation of retraction joints in works of concrete in accordance with the present invention.
Figure 2:
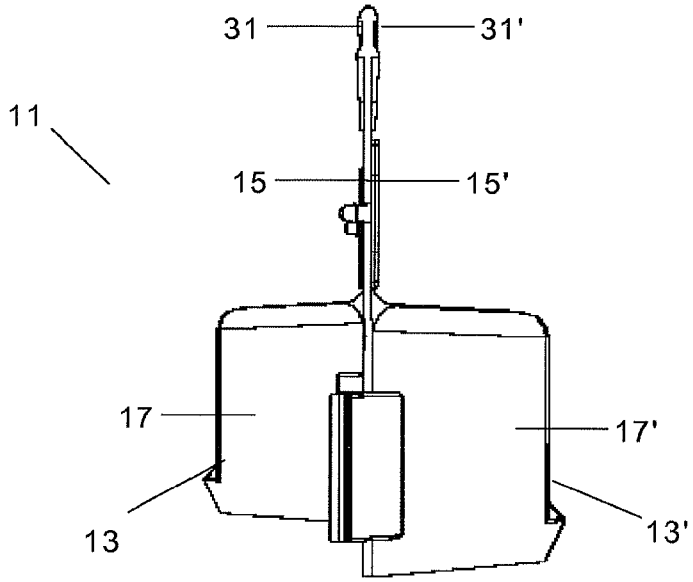
Figure 3:
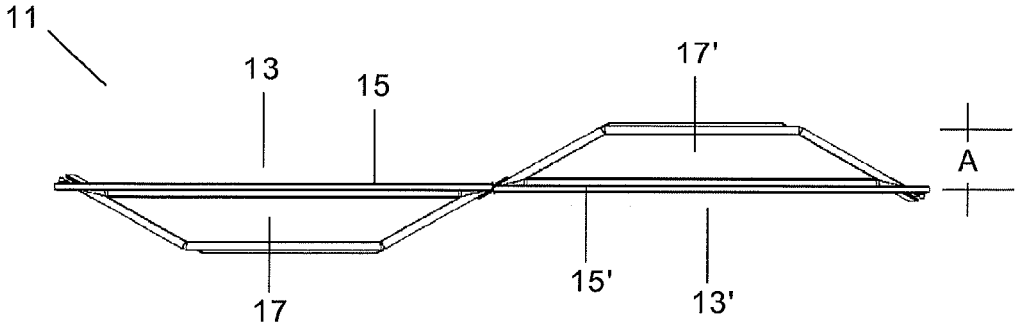
FIG. 3 is a top view of the device of FIGS. 1 and 2.
Figure 4:
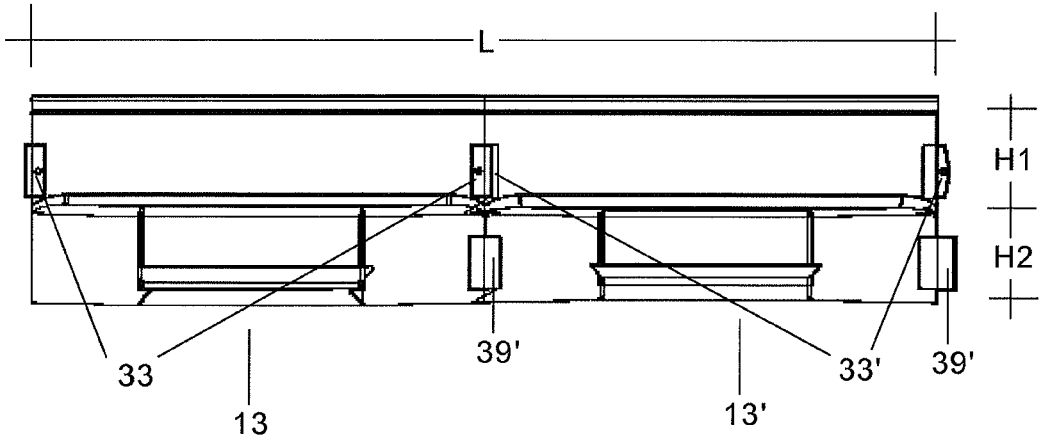
FIG. 4 is a raised frontal view of the device of FIGS. 1 and 2.

In the detailed description of the invention we will make reference to concrete pavements and will use the terms "horizontal" and "vertical" in the sense normally used in this regard. A person skilled in the art will understand without difficulty that if we refer to the surface of the pavement as a horizontal surface it is because we assume that the surface of the ground is horizontal, without this limiting the application to geometrically horizontal pavements. Analogously a person skilled in the art will understand without difficulty that the invention is not only applicable to concrete pavements, but also to any other work in which the same problem of the imbrication of adjacent slabs arises, as occurs, for example, in walls or canals. Therefore, for purposes of the present invention, the term concrete pavement should be understood in the wide sense, applicable to any work of concrete that is subdivided into slabs by retraction joints.

Following FIGS. 1-4, it can be seen that device 11 for the formation of retraction joints in works of concrete in accordance with the invention, of a length L, is formed by two trays, 13, 13' of length L/2, with vertical walls 15, 15' (that is to say, intended to remain in a vertical position in the concrete pavement) with a height H1 and some substantially equal prismatic surfaces 17, 17', of height H2 and width A, deployed on each tray 13, 13' in alternating sides with respect of said vertical walls 15, 15' and configured for the formation of entries and exits imbricated between the adjacent slabs in the shape of teeth, that are supported by, respectively, surfaces 21, 21' that form angles of between 0° and −10° with respect of the horizontal plane (that is, the ground plane or the plane of the surface that is flush with the pavement, which ideally are parallel. Surfaces 21, 21' have a slight descending gradient from vertical walls 15, 15' that reaches their edges to facilitate the sliding of the slabs on top of them when they are shortened.

Device 11 also includes some heads 31, 31' on its bottom part for placing a seal joint (this is done once the assembly of trays 13, 13' is mounted, with which the complete longitudinal joint is formed). Trays 13, 13' are equipped, respectively, with cooperating means of lateral union 33, 33', 39' (hole, swivel) on their vertical walls 15, 15', and tray 13' is equipped with two fins on the edges of prismatic surface 17' between which prismatic surface 17 is located, leaving device 11 immobilized.

Devices 11 are prefabricated, either divided into said two trays 13,13' or as a unitary assembly, with appropriate dimensions according to the different types of works to which they are destined.

For pavements of concrete said dimensions fall with in the ranges indicated below:

H1 between 20%-70% of the height of the pavement.

H2 between 20%-70% of the height of the pavement.

L between 20 cm-200 cm.

A between 0.5 cm-10 cm.

Devices 11 are prepared for being placed in the planned position for the formation of the retraction joints over the recently extended concrete. As many devices as may be necessary are placed adjacently (or leaving some free spaces between them) to cover the length of the joint.

The material from which said devices 11 are made can be polypropylene, PVC, polyamide, tin sheets or other suitable material for serving as a separating element of the concrete.

The material of which the seal joint is made of can be paste, PVC, cork or other material impermeable to water.

A procedure for the formation of retraction joints in pavements of concrete using devices 11 in accordance with the invention, is based on the insertion in the position planned for each retraction joint of a plurality of devices 11 following the extension of the concrete when the concrete is still fresh.

This procedure permits the frontal feed of the concrete to the pavement without any element that obstructs the work in front of the paver. The placement of the devices is mechanical, so guaranteeing a good placement, without them being able to move afterwards, as the pavement is already executed.

Figure 5:
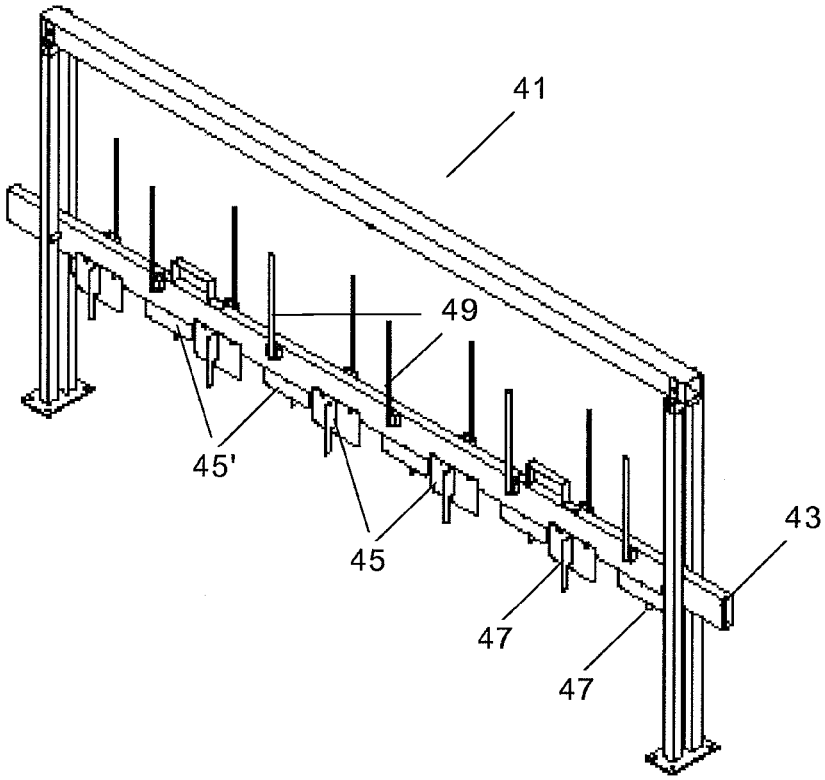
FIG. 5 is a perspective view of a machine for the insertion of devices for the formation of retraction joints in works of concrete in accordance with the present invention.

In accordance with the invention, said procedure is implemented by means of machine 41 (see FIG. 5) coupled to the paver or independently of it, and which comprises:

A ruler 43 equipped with pusher plates for each one of said devices. In the embodiment shown in FIG. 5, pusher plates 45 of trays 13 and pushing plates 45' of trays 7, 13' are used. Each one of plates 45, 45' has an elbow 47, 47' that prevents transversal displacement of the bottom part of trays 13, 13'.

Means of vertical displacement of said ruler 43.

Means of vibration of the concrete, such as vibrators with vertical pins (not depicted in FIG. 5) supported on masts 49.

From among the significant advantages of the invention the following may be pointed out:

seal joint that remains flush with the same level as the pavement.

Devices 11 can be placed above the ground (that is, without being propped up or attached to the ground) thus ensuring their due position with respect of the grade, eliminating the problem that arises when the terrain and the gradient to be obtained are not perfectly parallel. This enables obtaining a completely straight fissure line. All of the fissures between the slabs have the same width given that the retraction of each slab is independent from the others because they are isolated one from another, except for the distance to the ground of the lowest part of device 11, which is just a few centimeters. The shortening is produced with respect to the centre of gravity of each slab and, consequently, all of them have a fissure with the same width.

The flaking of the edges of the slabs is minimized because seal joints with a reduced width can be used, for example, of 2 mm.

It enables obtaining a difference of elevation between the edges of the adjacent slabs that is less than 0.05 mm, for which the load transfer between adjacent slabs is close to 100%.

The present invention is not limited by the described embodiments, but rather by any other that comes within the scope defined by the following claims.

The invention claimed is:

1. A device for forming pavement of concrete or another material that is subject to retraction, wherein the concrete is subdivided into slabs by a retraction joint, the device being made of a material suitable for inserting into concrete to subdivide it into portions, the device comprising (a) a top portion comprising a linear wall that is adapted to be disposed vertically with respect to a horizontal plane defined by the pavement, and (b) a bottom portion disposed below the vertical wall comprising respective first and second prismatic surfaces disposed on opposite sides of the vertical wall and comprising side walls adjacent to the first and second prismatic surfaces that are adapted to be disposed vertically with respect to the horizontal plane, said first and second prismatic surfaces comprising respective first and second support faces and being configured to form the concrete with adjacent slabs that have imbricated recesses and protrusions on opposing sides of the retraction joint wherein respective of the adjacent slabs are supported by respective of the first and second support faces, wherein the first and second support faces of the prismatic surfaces are disposed with respect to the horizontal plane formed by the pavement at a descending angle that facilitates sliding of the adjacent slabs on the support faces when they are shortened, said angle being less than 10°, wherein the device has a total height of H1 plus H2 with the bottom portion having a height H2, wherein H1 and H2 can be selected such that the total height is less than a thickness of the pavement and, in use, a lowest part of the bottom portion extends a few centimeters above the ground without being propped up or attached to the ground whereby the device can be used to form a seal joint that is flush with a level of the pavement, and wherein a plurality of the devices are joinable together to form a continuous seal joint.

2. The device according to claim 1, wherein the vertical wall has a height that is between 20-70% of a height of the pavement.

3. The device according to claim 1, wherein the device has a length that is between 20-200 cm.

4. The device according to claim 1, wherein each of the first and second prismatic surfaces has a width that is between 0.5 cm and 10 cm.

5. The device according to claim 1, wherein the device is formed by first and second substantially equal trays, wherein the trays differ only in respect of the respective orientation of the first and second prismatic surfaces.

6. An apparatus comprising a plurality of the devices according to claim 5, wherein the devices are joined together.

7. A method for formation of a retraction joint in pavement of concrete or another material that is subject to retraction comprising the steps of:

(a) providing a plurality of the devices according to claim 1;

(b) ascertaining a desired place for the retraction joint in the concrete; and (c) inserting the plurality of the devices in fresh concrete after extension of the concrete, the devices being inserted in the fresh concrete a few centimeters above the ground without being propped up or attached to the ground, the devices being inserted in an alignment that will result in formation of a seal joint the retraction joint in the desired place that is flush with a level of the pavement.

8. An apparatus for formation of retraction joints in pavement of concrete comprising:

(a) a plurality of devices according to claim 1; and (b) a machine for insertion of the plurality of devices in fresh concrete, the machine comprising (i) a ruler equipped with pusher plates for each of the plurality of devices and (ii) means for vertical displacement of the ruler.

9. The device according to claim 1, wherein the first and second prismatic surfaces are of trapezoidal shape.

10. The device according to claim 1, wherein the side walls abut each other.

11. The device according to claim 1, wherein the side walls are quadrilateral.

* * * * *